US008201299B2

(12) United States Patent
Dondi et al.

(10) Patent No.: US 8,201,299 B2
(45) Date of Patent: Jun. 19, 2012

(54) TOOL FOR CLEANING SURFACES

(75) Inventors: Andrea Dondi, Casinalbo (IT); Roberto Dondi, Casinalbo (IT)

(73) Assignees: Andrea Dondi, Casinalbo (IT); Roberto Dondi, Casinalbo (IT)

( * ) Notice: Subject to any disclaimer, the term of this patent is extended or adjusted under 35 U.S.C. 154(b) by 1382 days.

(21) Appl. No.: 11/663,750

(22) PCT Filed: Sep. 22, 2005

(86) PCT No.: PCT/EP2005/010248

§ 371 (c)(1),
(2), (4) Date: May 3, 2007

(87) PCT Pub. No.: WO2006/034815

PCT Pub. Date: Apr. 6, 2006

(65) Prior Publication Data

US 2008/0120799 A1 May 29, 2008

(30) Foreign Application Priority Data

Sep. 28, 2004 (IT) ..... MO2004A0251

(51) Int. Cl.
*A46B 9/02* (2006.01)
*A46B 13/00* (2006.01)

(52) U.S. Cl. ..... 15/179; 15/49.1; 15/180

(58) Field of Classification Search ..... 15/179, 15/180, 22.1, 28, 49.1
See application file for complete search history.

(56) References Cited

U.S. PATENT DOCUMENTS

| | | | | |
|---|---|---|---|---|
| 1,497,921 | A | 6/1924 | Levedahl | |
| 3,398,422 | A | 8/1968 | Barry et al. | |
| 4,074,385 | A | 2/1978 | Howard et al. | |
| 4,628,564 | A * | 12/1986 | Youssef | 15/167.1 |
| 7,788,756 | B2 * | 9/2010 | Kraemer | 15/28 |
| 2002/0138926 | A1 * | 10/2002 | Brown et al. | 15/22.1 |
| 2002/0166188 | A1 * | 11/2002 | Driesen et al. | 15/192 |

FOREIGN PATENT DOCUMENTS

| | | |
|---|---|---|
| DE | G8807968.6 | 11/1989 |
| EP | 0 765 642 A | 4/1997 |
| GB | 27844 A | 0/1909 |
| SU | 988271 | 1/1983 |
| WO | 01/43584 A | 6/2001 |

* cited by examiner

*Primary Examiner* — Randall Chin
(74) *Attorney, Agent, or Firm* — Nixon & Vanderhye P.C.

(57) ABSTRACT

A tool for cleaning surfaces, comprising a body with a substantially cylindrical shape, on a face of which there are distributed along at least a path clumps of bristles inserted into corresponding holes made on said face, the axis of each of said holes is inclined in relation to a perpendicular to the surface of said face, on a plane substantially tangential to said at least a path, or on a plane substantially radial to said path, or on both said planes.

32 Claims, 8 Drawing Sheets

TOOL FOR CLEANING SURFACES

This application is a continuation of PCT International Application No. PCT/EP2005/010248 filed 22 Sep. 2005. PCT/EP2005/010248 claims priority to International Application No. MO2004A000251 filed 28 Sep. 2004. The entire contents of this application is incorporated herein by reference.

BACKGROUND

The present invention relates to a rotating tool for cleaning surfaces, for example a brush that is applicable to a machine for cleaning floors.

In the prior art, tools are known for cleaning surfaces comprising a circular support on which clumps of bristles in synthetic, natural, abrasive etc materials are arranged.

The clumps can all be applied substantially perpendicular to the surface of the support or all be inclined substantially by the same angle towards the outside of the support, or all be inclined towards the outside of the support by an angle growing progressively from the central zone to the peripheral zone of the support.

The use of the clumps inclined towards the outside of the support has the aim of making floor cleaning possible even in the zones in contact with the walls.

The clumps are generally distributed on the support along circumferences that are concentric to one another in relation to the centre of the support.

The tools disclosed above nevertheless do not enable cleaning of the so-called "transitions" to be obtained in all cases, i.e. of the joining zones between adjacent tiles or briquettes; furthermore, cleaning irregular surfaces is much less satisfactory, both because of the difficulty of bristles in reaching all the points of an irregular surface, and because of the bumps that may easily occur on irregular surfaces during rotation of the tool.

SUMMARY

The object of the present invention is to provide a tool of the type mentioned above that ensures the possibility of obtaining an excellent degree of cleaning on each point of any surface.

According to a first aspect of the present invention a tool is provided for cleaning surfaces, comprising a support of substantially circular shape, on a face of which there are distributed along at least a path clumps of bristles inserted into corresponding holes made on, said face, characterised in that the axis of each of said holes is inclined in relation to a perpendicular to the surface of said face, on a plane that is tangent to said at least a path.

The clumps of bristle inserted into said holes are correspondingly inclined.

The clumps can be arranged along paths with a circumferal, or polygonal shape, possibly concentric, distributed on the surface of the support or along a spiral path that extends on the surface of the support.

The inclination of the clumps of bristles can vary along said circumference or polygon-shaped path between two maximum values of opposite signs.

According to a further aspect of the present invention a tool is provided for cleaning surfaces, comprising a support of substantially circular shape, on a face of which there are distributed along at least a path clumps of bristles inserted into corresponding holes made on said face, the axis of each of said holes being inclined in relation to a perpendicular to the surface of said face, on a plane that is radial to said at least a path, characterised in that the inclination angle of said axis is variable along said at least a path.

According to a still further aspect of the present invention, a tool is provided for cleaning surfaces, comprising a support of substantially circular shape, on a face of which there are distributed along at least a path clumps of bristles inserted into corresponding holes made on said face, characterised in that the axis of each of said holes is inclined in relation to a perpendicular to the surface of said face, the angle of inclination of said axis being the sum of a first inclination angle on a plane that is radial to said at least a path, and a second inclination angle on a plane tangential to said at least a path.

The inclination of clumps of bristles according to the present invention makes possible easy and optimal cleaning of each type of surface, in particular also irregular surfaces, and also enables the bristles to easily clean also the so-called "transitions" in the surfaces constituted by tiles or briquettes.

BRIEF DESCRIPTION OF DRAWINGS

Further features and advantages of the present invention will become apparent from the disclosure that follows of embodiment examples of the invention given merely by way of non-limitative example, with reference to the attached drawings, in which.

DETAILED DESCRIPTION

Figure 1:
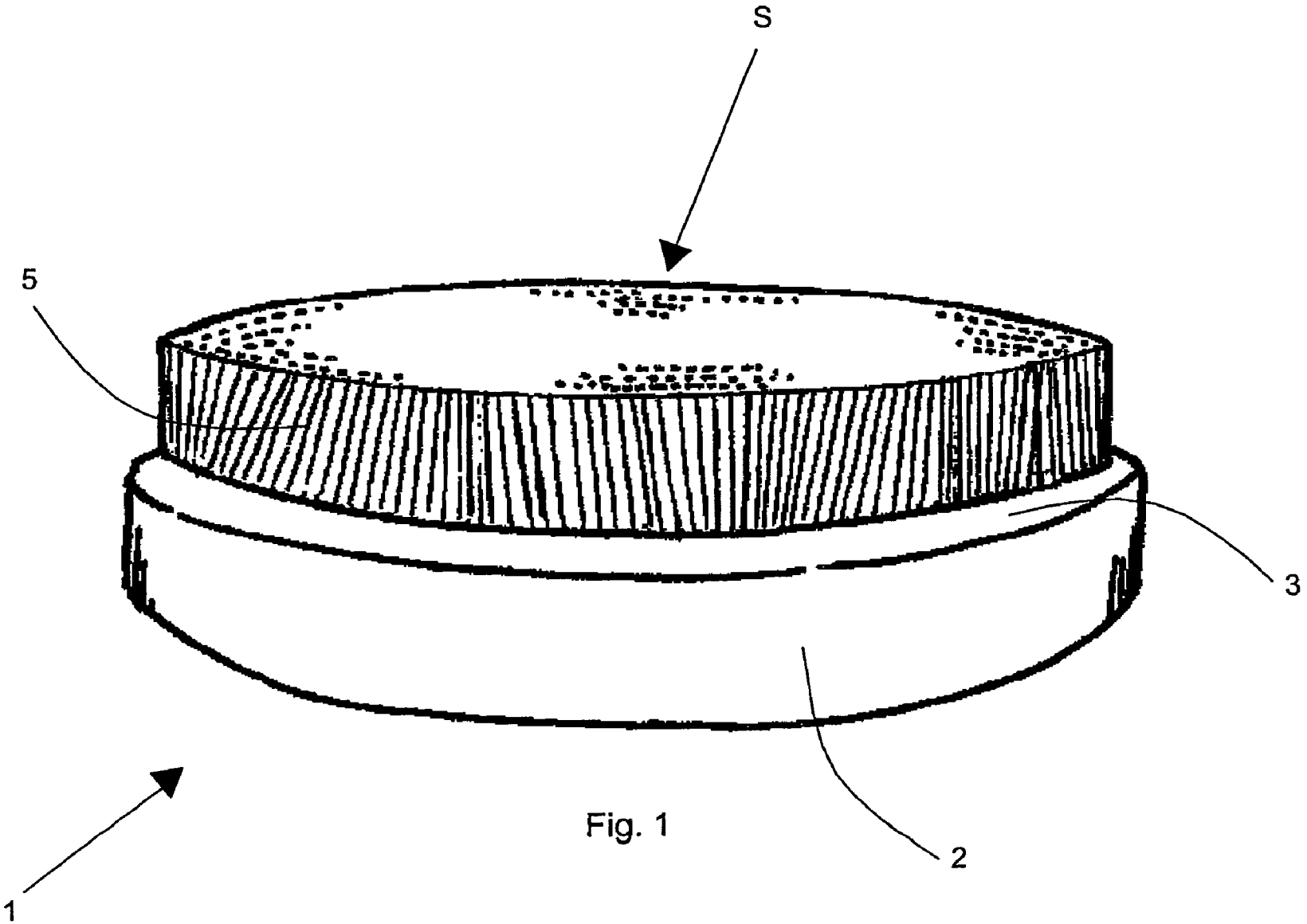
FIG. 1 is a perspective view of a first version of a tool according to the invention, in which the clumps of bristles are fixed in holes that are arranged along concentric circumferences on the surface of the support of the tool and have an axis inclined in relation to a plane tangential to said concentric circumferences; the clumps of bristles furthermore have different lengths depending on their inclination angle in such a way as to define a substantially flat surface for contacting the surface to be cleaned.

In FIG. 1, 1 indicates as a whole a tool according to the invention, provided with a body 2, for example with a substantially cylindrical shape, on a face 3 of which holes are made, which are not shown, in each of which a clump 5 of natural or artificial bristles is inserted. The holes are arranged on said face 3 along one or more paths, for example along a spiral path, or along a plurality of possibly concentric circumferences, or along a plurality of polygonal paths. The axis of each hole is inclined in relation to a perpendicular to said face on a plane substantially tangential to said path, in such a way that the clump of bristles inserted therein is correspondingly inclined.

The inclination angle a (FIG. 4) of the axis of each hole is variable between a first minimum value and a first maximum value in a first portion of said path, i.e. in a first spiral or circumference arch, from said first maximum value to a second minimum value in a second portion of path, from said second minimum value to a second maximum value, having an opposite sign with respect to the first maximum value, in a third portion of path and from said second maximum value to a third minimum value in a fourth portion of said path.

Advantageously, the portions of path are consecutive to one another, the minimum values are the same as one another, preferably approximately 0°, and the maximum values have substantially the same absolute value.

Preferably, the aforementioned first and second maximum values are approximately 25°-30°.

In the case of holes arranged along a spiral path, the sum of the lengths of the first, second, third and fourth portion of spiral path may be the same as the total length of the spiral path or of a portion thereof; in the latter case the inclinations of the axes of the holes will follow with the same sequence specified above, in one or more further groups of four portions of spiral path until the entire path has been completed.

In the case of holes arranged along circumferences that are concentric to one another, the sum of the aforementioned four portions of path may, for each circumference, be the same as the total length of the circumference or of a fraction thereof; in the latter case the inclinations of the axes of the holes will follow with the same sequence as specified above, in one or more further groups of four portions of spiral path, until the entire circumference has been completed.

Figure 4:
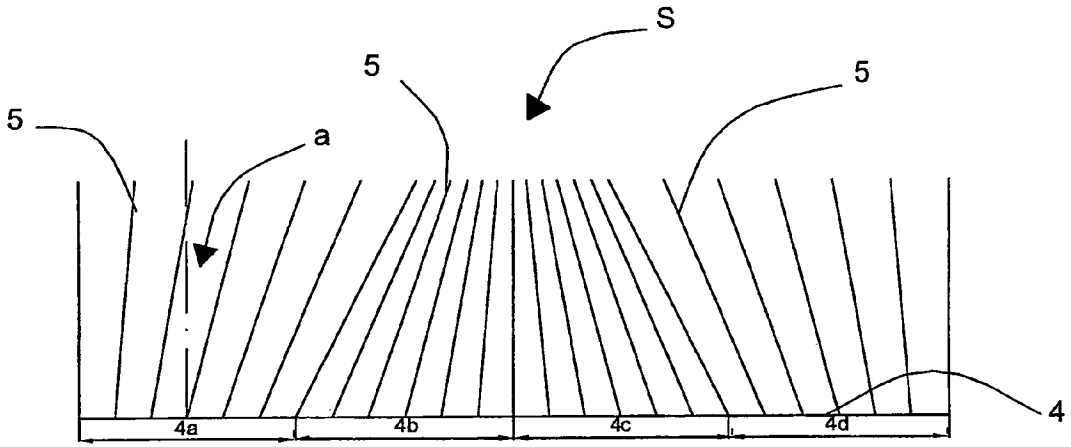
FIG. 4 illustrates schematically the arrangement of the clumps of bristles in the tool in FIG. 1, along a circumference, or a portion of circumference developed on a plane.

In FIG. 4 the arrangement of the groups of the clumps of bristles is schematised along a group of portions of rectified path 4, along which said holes are arranged, the clumps of bristles 5 are schematised with straight lines that substantially coincide with the axis of said holes. The inclination angle a of the axis of each hole is variable between 0° and 30° in a first portion 4*a* of rectified path, between 30 and 0° in a second portion 4*b* of path, between 0° and −30° in a third portion 4*c* of path and between −30° and 0 in a fourth portion 4*d* of path.

The lengths of the clumps of bristles 5 in FIGS. 1 and 4 is variable, depending on the inclination angle thereof, in such a way that the surface S of the bristles contacting a surface to be cleaned is substantially flat, which makes the cleaning of substantially flat surfaces easier.

Figure 2:
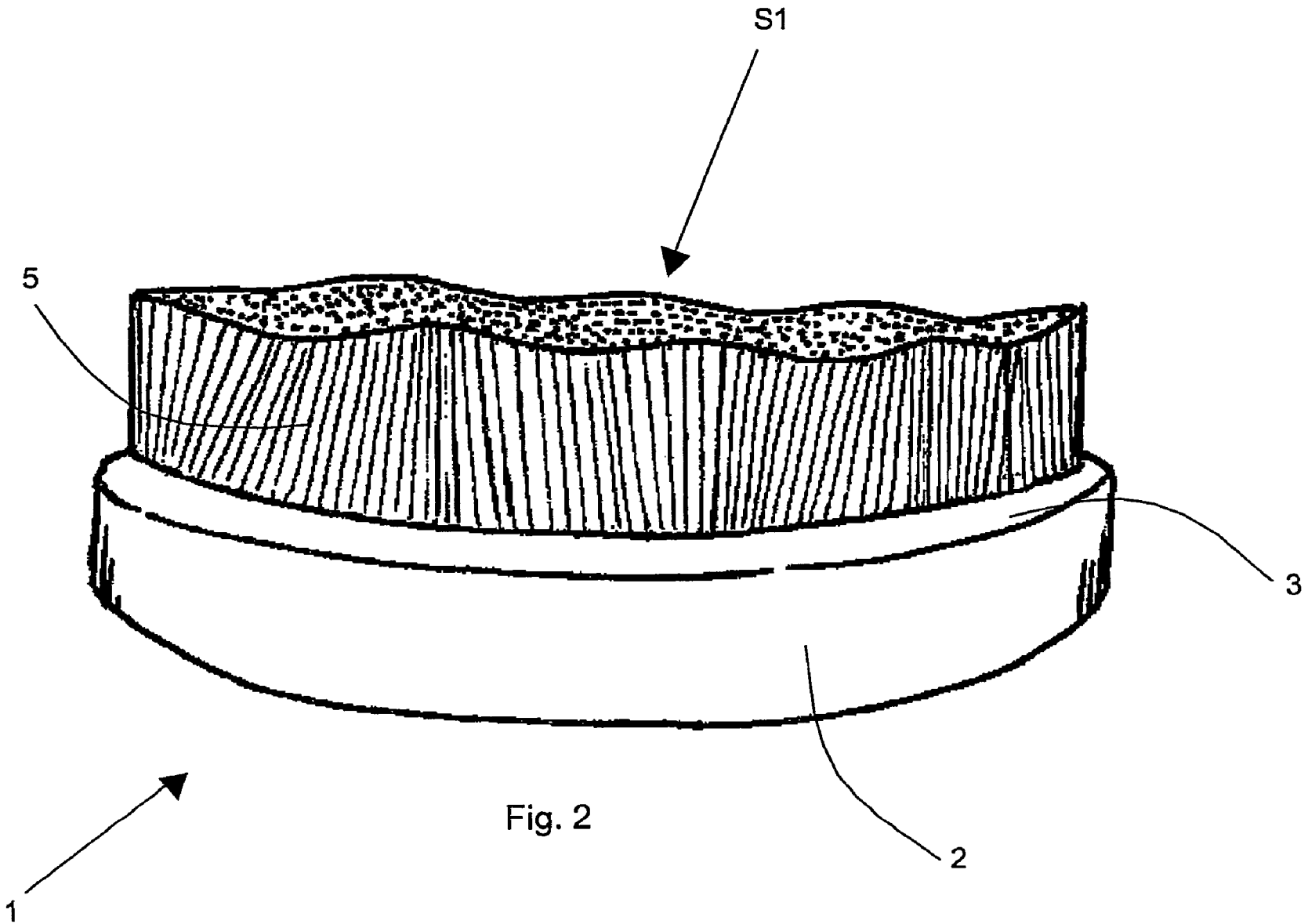
FIG. 2 is a perspective view of a variant of the tool in FIG. 1, in which the clumps of bristles all substantially have the same length so as to define a corrugated surface of the bristles for contacting the surface to be cleaned.
Figure 5:
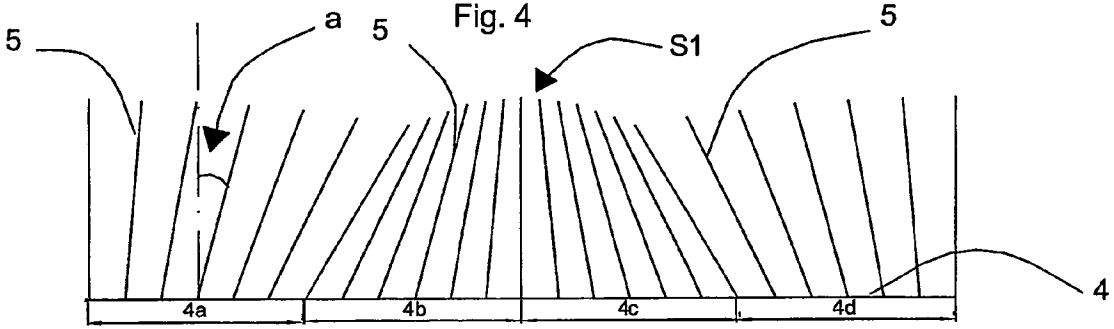
FIG. 5 illustrates schematically the arrangement of the clumps of bristles in the tool in FIG. 2, along a circumference, or a portion of circumference developed on a plane.

FIGS. 2 and 5 illustrate a variant of the tool shown in FIGS. 1 and 4. In this variant the clumps of bristles 5 are all of the same length, which means that the surface S1 of the bristles contacting a surface to be cleaned is corrugated, which is advantageous in the case of cleaning irregular surfaces.

Figure 3:
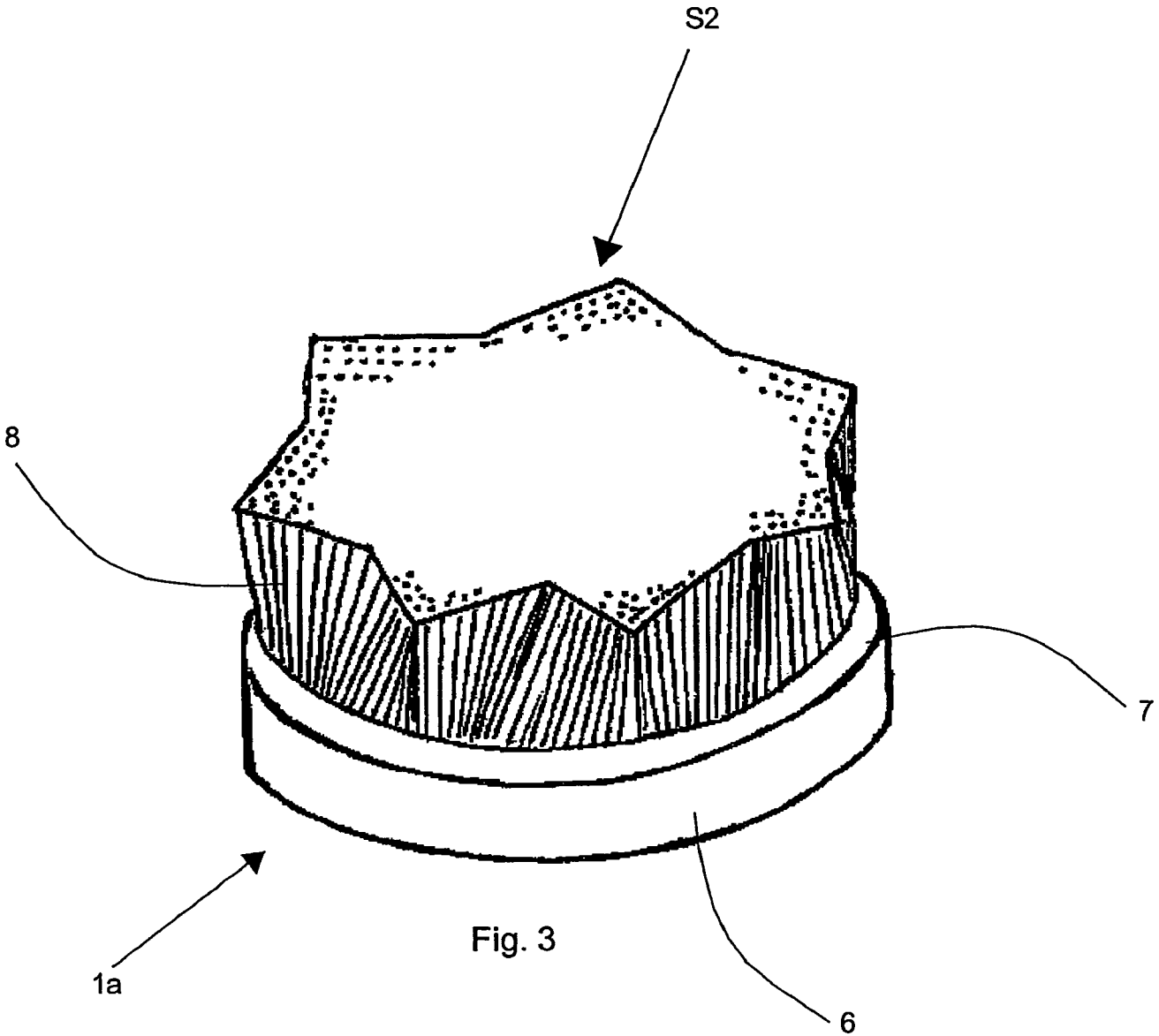
FIG. 3 is a perspective view of a second version of a tool according to the invention, in which the clumps of bristles are fixed in holes that are arranged along concentric circumferences on the surface of the tool support and have an axis inclined in relation to a plane radial to said concentric circumferences; the clumps of bristles furthermore have different lengths, depending on their inclination angle in such a way as to define a substantially flat surface for contacting the surface to be cleaned.

FIG. 3 illustrates a second embodiment of a tool 1*a* according to the invention, provided with a body 6, for example with a substantially cylindrical shape, on a face 7 of which holes are made, which are not shown, in each of which a clump of natural or artificial bristles 8 is inserted. The holes are arranged on said face 7 along one or more paths, for example along a spiral path or along a plurality of concentric circumferences. The axis of each hole is inclined in relation to a perpendicular to said face 7 on a plane that is substantially radial in relation to said path, in such a way that the clump of bristles inserted therein is correspondingly inclined.

The inclination angle of the axis of each hole is variable between a first minimum value and a first maximum value in a first portion of said path, i.e. in a first spiral or circumference arch, from said first maximum value to a second minimum value in a second portion of path, from said second minimum value to a second maximum value, having an opposite sign with respect to the first maximum value, in a third portion of path and from said second maximum value to a third minimum value in a fourth portion of said path.

Advantageously, the portions of path are consecutive to one another, the minimum values are the same, preferably about 0°, and the maximum values have substantially the same absolute value.

Preferably, said first and second maximum values can be advantageously about 25°-30°.

In the case of holes arranged along a spiral path, the sum of the lengths of the first, second, third and fourth portions of spiral path may be the same as the total length of the spiral path or the same as a fraction thereof; in the latter case, the inclinations of the axes of the holes will follow one another with the same sequence as specified above, in one or more further groups of four portions of spiral path until the entire path has been completed.

In the case of holes arranged along circumferences that are concentric to one another the sum of the above four portions of path may, for each circumference, be the same as the total length of the circumference or a fraction of it; in this latter case the inclinations of the axes of the holes will follow one another with the same sequence specified above, in one or more further groups of four portions of spiral path, until the entire circumference is completed.

Figure 6:
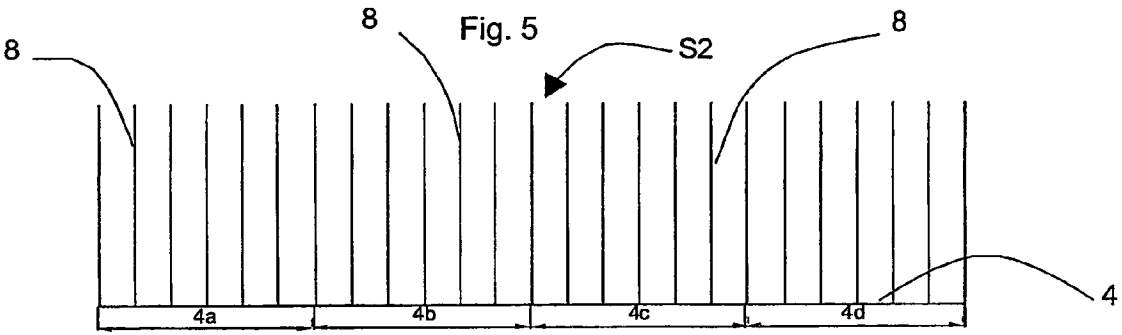
FIG. 6 illustrates schematically the arrangement of the clumps of bristles in the tool in FIG. 3, along a circumference, or a portion of circumference developed on a plane.
Figure 7:
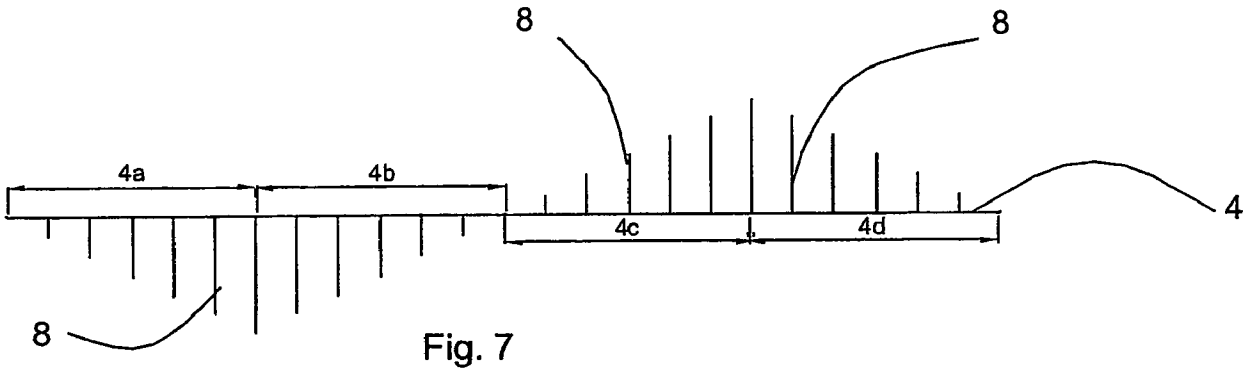
FIG. 7 is the view from above of the arrangement of the clumps of bristles in FIG. 6.

In FIGS. 6 and 7 a group of portions of rectified path 4 is schematised along which said holes are arranged, the clumps of bristles 8 are schematised with straight lines that substantially coincide with the axis of said holes. The group of portions of path 4 is shown in a side view in FIG. 6 and in a view from above in FIG. 7. The inclination angle of the axis of each hole is variable between 0° and 30° in a first portion 4*a* of path, between 30 and 0° in a second portion 4*b* of path, between 0° and −30° in a third portion 4*c* of path and between −30° and 0 in a fourth portion 4*d* of path.

The lengths of the clumps 8 of bristles in FIGS. 3, 6 and 7 are variable depending on the inclination angle thereof, in such a way that the surface S2 of the bristles contacting a surface to be cleaned is substantially flat.

Figure 8:
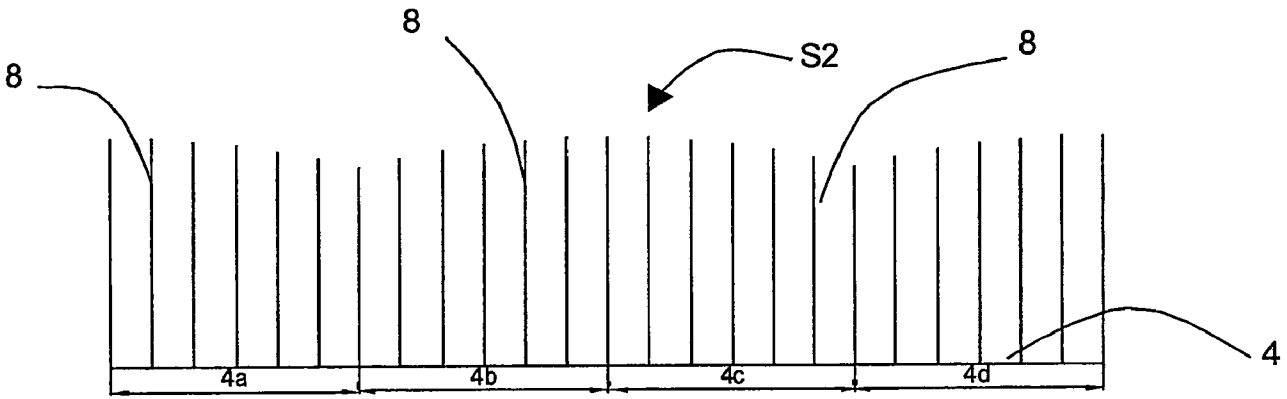
FIG. 8 illustrates schematically the arrangement of the clumps of bristles in a tool similar to the one in FIG. 3, along a circumference, or a portion of circumference developed on a plane, in which the clumps of bristles are all substantially of the same length, so as to define a surface that is substantially corrugated for contacting a-surface to be cleaned.
Figure 9:
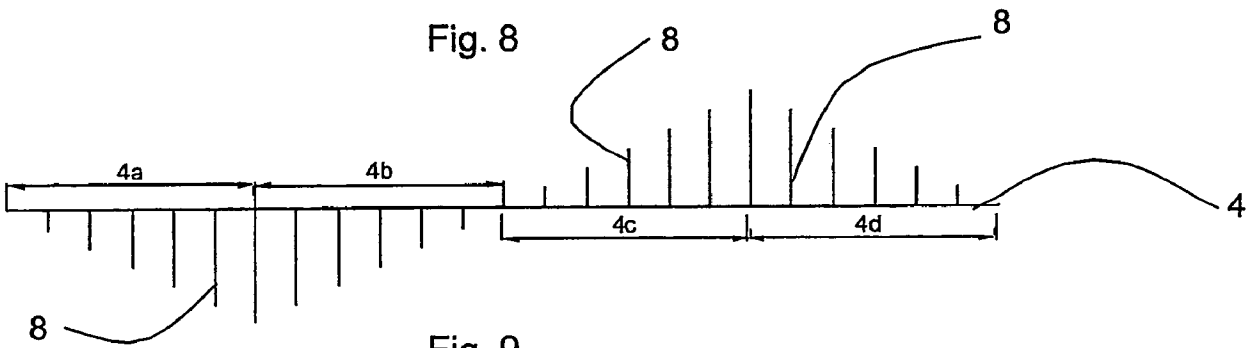
FIG. 9 is a view from above of FIG. 8.

FIGS. 8 and 9 are similar to FIGS. 6 and 7 and illustrate a variant of the tool 1*a* shown in FIGS. 3, 6 and 7. In this version, the clumps 8 of bristles are all substantially of the same length, which means that the surface S2 of the bristles contacting a surface to be cleaned is corrugated.

Figure 10:
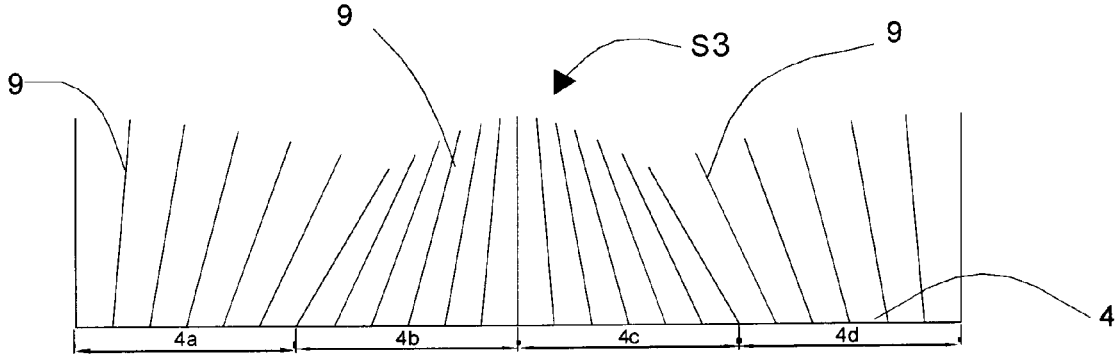
FIG. 10 illustrates schematically the arrangement of the clumps of bristles in a third tool embodiment according to the invention along a circumference, or a portion of circumference, developed on a plane; in this third embodiment the clumps of bristles are inclined both on a plane tangential to said circumference or portion of circumference and on a radial plane, the clumps of bristles furthermore all have the same length, so as to define a corrugated surface for contacting a surface to be cleaned.
Figure 11:
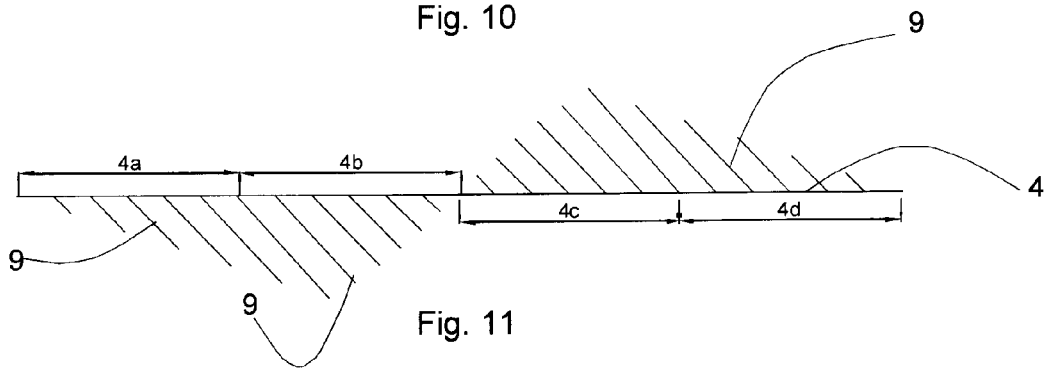
FIG. 11 is a view from above of FIG. 10.

FIGS. 10 and 11 illustrate schematically a still further embodiment of a tool according to the invention.

Similarly to the previously disclosed embodiments, the tool comprises a body, for example with a substantially cylindrical shape, on a face of which holes are made, which are not shown, in each of which a clump of natural or artificial bristles is inserted. The holes are arranged on said face along one or more paths, for example along a spiral path, or along a plurality of concentric circumferences. In this still further version the axis of each of the holes is inclined in relation to a perpendicular to said face both on a plane substantially tangential to said path and on a plane substantially radial to said path, in such a way that the clump of bristles inserted therein is correspondingly inclined.

The inclination angle of the axis of each hole on both of the aforementioned planes is variable between a first minimum value and a first maximum value in a first portion of said path, i.e. in a first spiral or circumference arc from said first maximum value to a second minimum value in a second portion of path, from said second minimum value to a second maximum value, having an opposite sign with respect to the first maximum value, in a third portion of path and from said second maximum value to a third minimum value in a fourth portion of said path.

Advantageously, the portions of path are consecutive to one another, the minimum values of said inclination angle being the same, preferably approximately 0°, and the maximum values have substantially the same absolute value.

Preferably, the aforementioned first and second maximum values are approximately 25°-30°.

In the case of holes arranged along a spiral path, the sum of the lengths of the first, second, third and fourth portions of spiral path may be the same as the total length of the spiral path, or of a fraction thereof; in the latter case the inclinations of the axes of the holes will follow one another with the same sequence specified above in one or more further groups of four portions of spiral path until the entire path is completed.

In the case of holes arranged along circumferences that are concentric to one another the sum of the aforementioned four portions of path, for each circumference, may be the same as the total length of the circumference or a fraction thereof; in the latter case the inclinations of the axes of the holes will follow one another with the same sequence specified above in one or more further groups of four portions of spiral path until the entire path is completed.

In FIGS. 10 and 11 a group of portions of rectified path 4 is schematised along which said holes are arranged, the clumps of bristles 9 are schematised with straight lines, that substantially coincide with the axis of said holes. The group of portions of path 4 is shown in a side view in FIG. 10 and in a view from above in FIG. 11. The inclination angle of the axis of each hole varies between 0° and 30°, both on said substantially tangential plane and on said substantially radial plane, in a first portion 4*a* of path, between 30 and 0° in a second portion 4*b* of path, between 0° and −30° in a third portion 4*c* of path and between −30° and 0 in a fourth portion 4*d* of path.

The lengths of the clumps 9 of bristles in FIGS. 10 and 11 are the same, in such a way that the surface S3 of the bristles contacting a surface to be cleaned is substantially corrugated.

Figure 12:
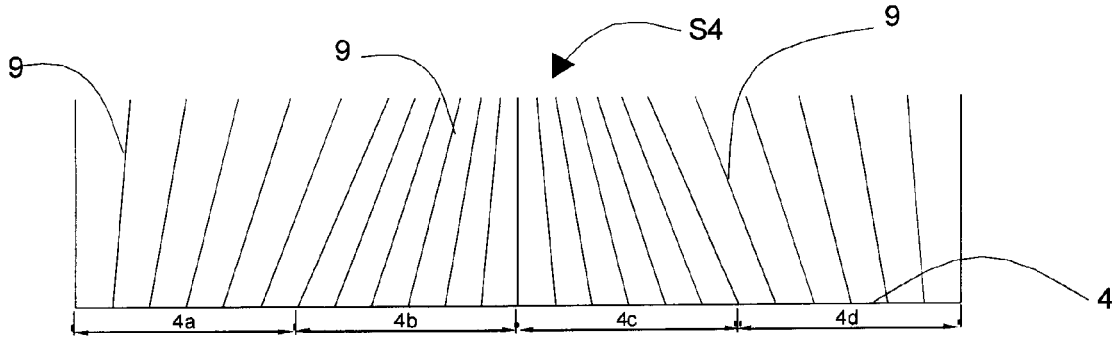
FIGS. 12 and 13 illustrate schematically the arrangement of the clumps of bristles, in a variant of the tool in FIG. 10, along a circumference, or a portion of circumference, developed on a plane; the inclination of the clumps of bristles is the same as that of the tool in FIG. 10, but the clumps of bristles have different lengths, depending on their inclination, in such a way as to define a substantially flat surface for contacting a surface to be cleaned.
Figure 13:
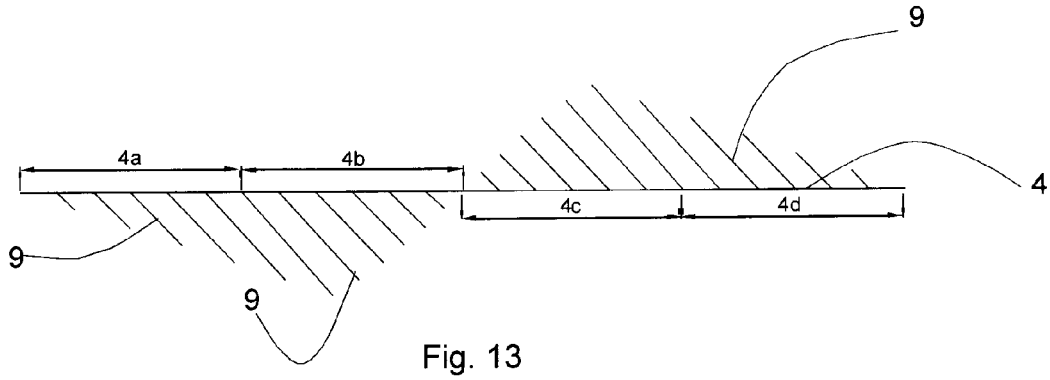

FIGS. 12 and 13 similar to FIGS. 10 and 11 and show a version of the tool shown in said Figures. In this version, the clumps 9 of bristles have different lengths, which means that the surface S4 of the bristles contacting a surface to be cleaned is flat.

Figure 16:
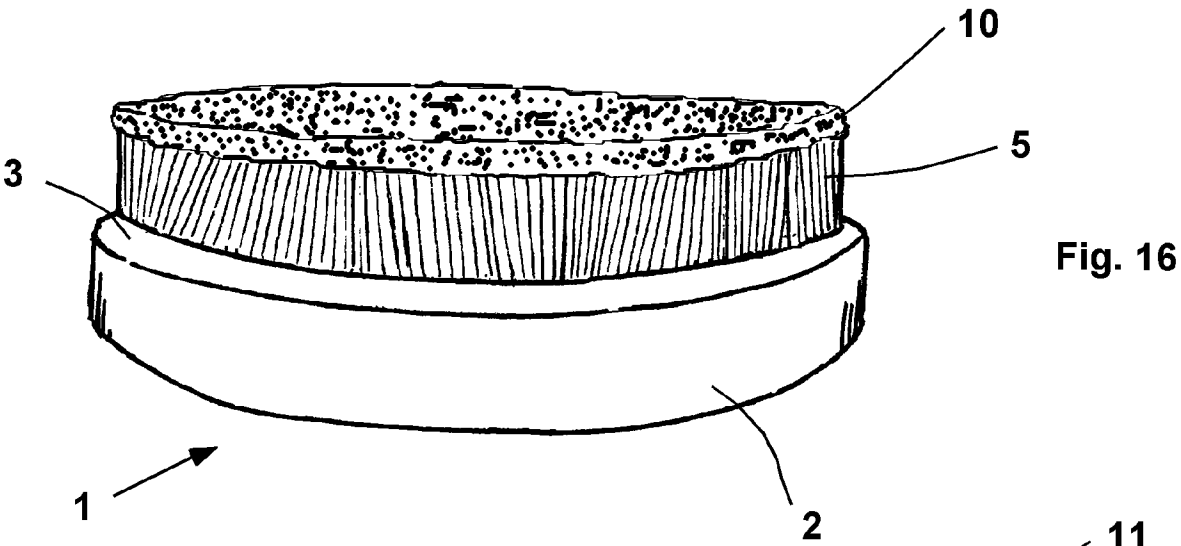
FIG. 16 is a perspective and schematic view of a tool according to the invention, comprising a sponge element fitted on the ends of the clumps of bristles.
Figure 17:
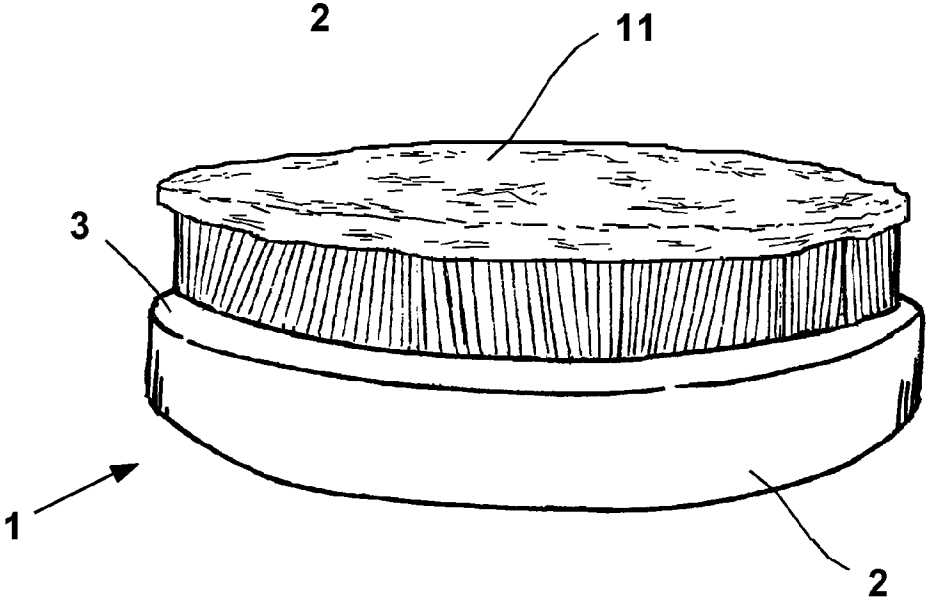
FIG. 17 is a perspective and schematic view of a tool according to the invention, comprising a felt element fitted on the ends of the clumps of bristles.

The tool according to the invention is also particularly suitable for dragging a sponge element 10 (FIG. 16) or a felt element 11 (FIG. 17) intended to polish surfaces. These sponge or felt elements 10, 11 may simply be placed over the clumps of bristles of a tool according to the invention, in such a way that the ends of the bristles penetrate for a short portion into the sponge or felt element 10, 11. The variable inclinations of the clumps of bristles, as disclosed above, ensure that the sponge or felt element 10, 11 remains in position during tool rotation. In order to make anchorage of a sponge or felt element 10, 11 to the bristles of a tool according to the invention more secure, it is advantageous for the length of the bristles of each group to be reduced in such a way that the bristles are noticeably stiff. It is also advisable to reduce the number of groups of bristles to what is strictly necessary to ensure anchoring of the sponge or felt element 10, 11.

Figure 14:
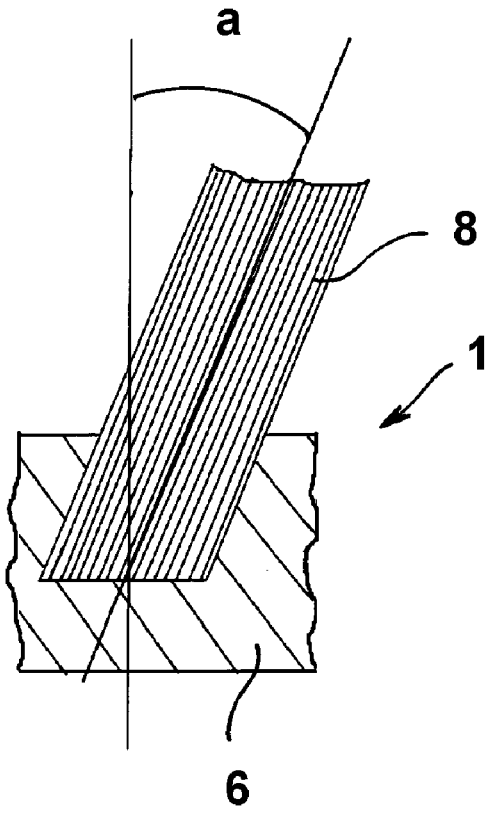
FIGS. 14 and 15 are enlarged, partial section views showing sample angles of holes in which clumps are disposed.

FIG. 14 is an enlarged, partial sectional view of tool 1. In the body 6 of the tool 1 a hole has been obtained, into which a clump 8 is inserted. The section has been taken parallel to a plane that is substantially tangential to a path along which the clumps of bristles are distributed (although only one clump is shown).

The axis of the hole is inclined in relation to a perpendicular to the upper surface of the body 6 and at an angle (a).

Figure 15:
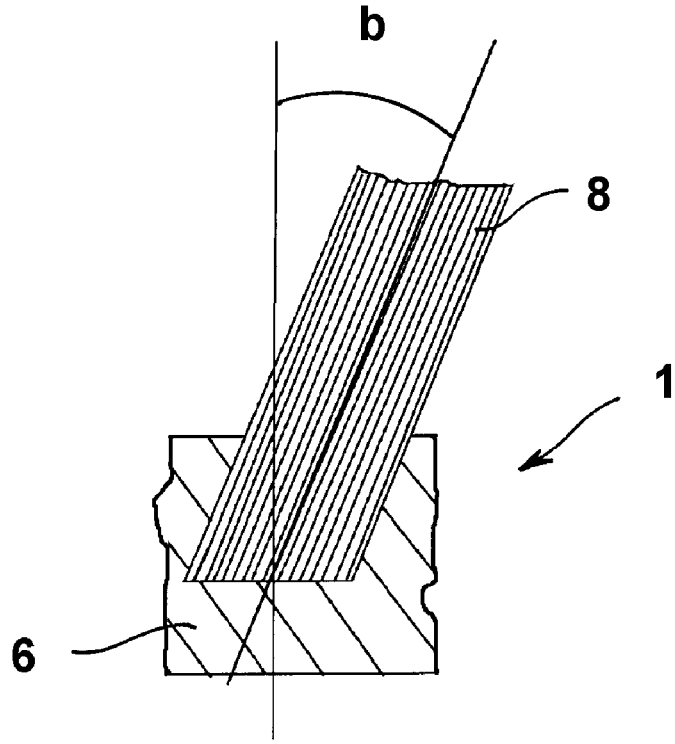

FIG. 15 is an enlarged, partial sectional view like the one shown in FIG. 14, wherein the section has been taken parallel to a plane that is substantially radial to the path along which the clumps of bristles are distributed.

The axis of the hole is inclined in relation to a perpendicular to the upper surface of the body 6 at an angle (b).

In the practical embodiment, the materials, dimensions and constructional details may be different from those indicated but be technically equivalent thereto without thereby falling outside the scope of legal protection of the present invention.

The invention claimed is:

1. A tool for cleaning floor surfaces, or floor-like surfaces, comprising a support of substantially circular shape, on a face of which along at least one path clumps of bristles are distributed that are inserted into corresponding holes made on said face, wherein the axis of each of said holes is inclined in relation to a perpendicular to the surface of said face, said axis of each said holes having an angle of inclination that is the sum of a first angle of inclination on a plane substantially radial to said at least one path, and a second angle of inclination on a plane substantially tangential to said at least one path, at least one of said first angle of inclination and said second angle of inclination having an amplitude that is variable from a first minimum value to a first maximum value in at least one first portion of said at least one path.

2. The tool according to claim 1, wherein said at least one path has a spiral shape.

3. The tool according to claim 1, wherein said at least one path has a circumference or polygonal shape.

4. The tool according to claim 3, wherein said at least one path comprises a plurality of paths with a circumference or polygonal shape that are concentric to one another.

5. The tool according to claim 1, wherein said first angle of inclination has an amplitude that is variable between said first minimum value and said first maximum value in said first portion of said at least one path and said second angle of inclination has an amplitude that is variable between a further first minimum value and a further first maximum value in said at least one first portion of said at least one path.

6. The tool according to claim 5, wherein said further first minimum value is about 0°.

7. The tool according to claim 5, wherein said further first maximum value is comprised between about 25° and about 45°.

8. The tool according to claim 5, wherein said second angle of inclination has an amplitude that is variable between said further first maximum value and a further second minimum value in said at least one second portion of said at least one path.

9. The tool according to claim 8, wherein said further second minimum value is about 0°.

10. The tool according to claim 1, wherein said at least one first portion comprises a plurality of first portions of said at least one path, that are not consecutive to one another.

11. The tool according to claim 1, wherein said first minimum value is about 0°.

12. The tool according to claim 1, wherein said first maximum value is comprised between about 25° and about 45°.

13. The tool according to claim 1, wherein said first angle of inclination has an amplitude that is variable between said first maximum value and a second minimum value, in at least one second portion of said at least one path.

14. The tool according to claim 13, wherein said second minimum value is about 0°.

15. The tool according to claim 13, wherein said first angle of inclination has an amplitude that is variable between said second minimum value and a second maximum value, in at least one third portion of said at least one path, said second maximum value having an opposite sign with respect to said first maximum value.

16. The tool according to claim 15, wherein said second angle of inclination has an amplitude that is variable between said further second minimum value and a further second maximum value in said at least one third portion, said further second maximum value having an opposite sign with respect to said further first maximum value.

17. The tool according to claim 16, wherein said further second maximum value is comprised between about 25° and about 45°.

18. The tool according to claim 15, wherein said at least one third portion is consecutive to said at least one second portion.

19. The tool according to claim 15, wherein said at least one third portion comprises a plurality of third portions of said at least one path, that are not consecutive to one another.

20. The tool according to claim 19, wherein said at least one second portion comprises a plurality of second portions of said at least one path, that are not consecutive to one another, each third portion of said plurality of third portions being consecutive to a respective second portion of said plurality of second portions.

21. The tool according to claim 15, wherein said second maximum value is comprised between about 25° and about 45°.

22. The tool according claim 15, wherein said first angle of inclination has an amplitude that is variable between said second maximum value and a third minimum value, in at least one fourth portion of said at least one path.

23. The tool according to claim 22, wherein said second angle of inclination has an amplitude that is variable between said further second maximum value and a further third minimum value in said at lest one fourth portion.

24. The tool according claim 23, wherein said further third minimum value is about 0°.

25. The tool according to claim 22, wherein said at least one fourth portion is consecutive to said third portion.

26. The tool according to claim 22, wherein said at least one fourth portion comprises a plurality of fourth portions of said at least one path, that are not consecutive to one another.

27. The tool according to claim 26, wherein said at least one third portion comprises a plurality of third portions of said at least one path, that are not consecutive to one another, each fourth portion of said plurality of fourth portions is consecutive to a respective third portion of said plurality of third portions.

28. The tool according to claim 22, wherein said third minimum value is about 0°.

29. The tool according to claim 1, wherein said at least one second portion is consecutive to said at least one first portion.

30. The tool according to claim 1, wherein said at least one second portion comprises a plurality of second portions of said at least one path, that are not consecutive to one another.

31. The tool according to claim 30, wherein said at least one first portion comprises a plurality of first portions of said at least one path, that are not consecutive to one another, each second portion of said plurality of second portions being consecutive to a respective first portion of said plurality of first portions.

32. The tool according to claim 1, further comprising a sponge or felt element fitted on ends of said clumps of bristles.

* * * * *